US006831412B2

(12) United States Patent
Amatsuchi

(10) Patent No.: US 6,831,412 B2
(45) Date of Patent: Dec. 14, 2004

(54) PLASMA DISPLAY PANEL

(75) Inventor: Mario Amatsuchi, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 0 days.

(21) Appl. No.: 10/247,336

(22) Filed: Sep. 20, 2002

(65) Prior Publication Data

US 2003/0222580 A1 Dec. 4, 2003

(30) Foreign Application Priority Data

Feb. 6, 2002 (JP) ..... 2002-29698

(51) Int. Cl.[7] ..... H01J 11/00
(52) U.S. Cl. ..... 313/586; 313/587
(58) Field of Search ..... 313/585–587, 313/584; 345/41, 60; 315/169.4

(56) References Cited

U.S. PATENT DOCUMENTS 6,465,956 B1 * 10/2002 Koshio et al. ..... 313/586
6,628,076 B2 * 9/2003 Amatsuchi ..... 313/586

FOREIGN PATENT DOCUMENTS

JP 11096919 9/1999

* cited by examiner

*Primary Examiner*—Ashok Patel
(74) *Attorney, Agent, or Firm*—Arent Fox PLLC

(57) ABSTRACT

A plasma display panel comprises a front glass substrate and a back glass substrate. A plurality of row electrode pairs regularly arranged in a column direction, each extending in a row direction to form a display line, and a dielectric layer covering the row electrode pairs are provided on an inner surface of the substrate. A plurality of column electrodes are provided on an inner surface of the substrate, and regularly arranged in the row direction, each extending in the column direction to intersect with the row electrode pairs to form discharge cells in a discharge space at the intersections. A recess groove is formed in a portion of the dielectric layer opposite a discharge gap between paired row electrodes constituting the row electrode pair, so that the dielectric layer has a thickness in the portion opposite the discharge gap smaller than that in portions on both sides of the portion opposite the discharge gap.

8 Claims, 13 Drawing Sheets

V1-V1 SECTION

V2-V2 SECTION

FIRST EMBODIMENT

V1-V1 SECTION

W1-W1 SECTION

SECOND EMBODIMENT

V2-V2 SECTION

W2-W2 SECTION

THIRD EMBODIMENT

V3-V3 SECTION

V3'-V3' SECTION

W3-W3 SECTION

FOURTH EMBODIMENT

V4-V4 SECTION

W4-W4 SECTION

FIFTH EMBODIMENT

V5-V5 SECTION

V-V SECTION

PLASMA DISPLAY PANEL

BACKGROUND OF THE INVENTION

1. Field of the Invention

This invention relates to a matrix plasma display panel using a gas discharge for producing light emission.

The present application claims priority from Japanese Application No. 2002-29698, the disclosure of which is incorporated herein by reference for all purposes.

2. Description of the Related Art

Currently, AC matrix plasma display panels using a gas discharge for producing light emission (hereinafter referred to as "PDP") has appeared on the market as an oversized and slim display for color screen.

FIGS. 16 and 17 show the cell construction of the AC matrix PDP which has already been proposed by the same applicant as the present application, FIG. 16 being a front view of the cell construction, and FIG. 17 being a sectional view taken along the V—V line of FIG. 16.

In FIGS. 16 and 17, a front glass substrate 1 serving as the display surface of the PDP is provided on its back surface with a plurality of row electrode pairs (X, Y) which are arranged in parallel, each extending in a row direction of the front glass substrate 1 (the right-left direction in FIG. 16).

Each of the row electrodes X includes transparent electrodes Xa each of which is formed of a transparent conductive film made of ITO or the like constructed in a letter-T shape, and a bus electrode Xb which is formed of a metal film extending in the row direction of the front glass substrate 1 and connected to a narrowed base end of each of the transparent electrodes Xa.

Likewise, each of the row electrodes Y includes transparent electrodes Ya each of which is formed of a transparent conductive film made of ITO or the like constructed in a letter-T shape, and a bus electrode Yb which is formed of a metal film extending in the row direction of the front glass substrate 1 and connected to a narrowed base end of each of the transparent electrodes Ya.

The row electrodes X and Y are arranged in alternate positions in the column direction of the front glass substrate 1 (the vertical direction in FIG. 16). In each row electrode pair (X, Y), the transparent electrodes Xa and Ya are regularly arranged along the corresponding bus electrodes Xb and Yb. The transparent electrodes Xa and Ya paired extend toward each other such that leading ends of widened portions of the respective electrodes Xa and Ya are opposite to each other with an interposed discharge gap g having a required width.

On the back surfaces of the front glass substrate 1, a dielectric layer 2 is also formed to cover the row electrode pairs (X, Y). On the back surface of the dielectric layer 2, an additional dielectric layer 2A is formed to protrude from the back surface of the layer 2 and extends in parallel to the bus electrodes Xb, Yb, in a position opposite to back-to-back bus electrodes Xb and Yb of the adjacent row electrode pairs (X, Y) plus opposite to an area between the back-to-back bus electrodes Xb and Yb concerned.

A protective layer 3 made of MgO is also provided on the back surfaces of the dielectric layer 2 and the additional dielectric layer 2A.

The front glass substrate 1 is situated in parallel to a back glass substrate 4 having a surface facing the display surface on which a plurality of column electrodes D are arranged in parallel at predetermined intervals and each extend in a direction at right angles to the row electrode pairs (X, Y) (or the column direction) in a position opposite the paired transparent electrodes Xa and Ya of the row electrode pairs (X, Y).

On the surface of the back glass substrate 4 on the display surface side, a white column-electrode protective layer 5 covers the column electrodes D, and partition walls 6 are formed on the protective layer 5.

The partition wall 6 is constructed in a ladder-shaped pattern by vertical walls 6*a* each extending in the column direction in a position between adjacent column electrodes D arranged in parallel to each other; and transverse walls 6*b* each extending in the row direction in a position opposite the additional dielectric layer 2A.

The ladder-patterned partition walls 6 partition a space defined between the front and back glass substrates 1 and 4 into sections each corresponding to the paired transparent electrodes Xa and Ya of each row electrode pair (X, Y), to define quadrangular discharge cells C.

A phosphor layer 7 is provided to cover five faces facing each discharge cell C: a face of the column-electrode dielectric layer 5 and the four inner side faces of the vertical walls 6*a* and transverse walls 6*b* of the partition wall 6. The phosphor layers 7 are arranged in order of a red color, a green color and a blue color along the row direction for each discharge cell C.

The discharge space S is filled with a discharge gas including xenon Xe.

In the PDP, an addressing discharge is generated between the row electrode Y and the column electrode D. Then, a sustaining discharge is generated between the row electrodes X and Y in each discharge cell of the discharge cells C having wall charges existing on the dielectric layer 2 as a result of the addressing discharge (lighted cell), to cause the red, green and blue phosphor layers 7 to emit light to thereby form an image in a matrix display.

In the PDP constructed as described above, the dielectric layer 2 provided for AC driving is formed by means of processes of printing a low-melting glass paste on the back surface of the front glass substrate 1 and then burning it, to have a thickness sufficiently larger than that of the row electrode X, Y, for example, a thickness around twenty to thirty times larger than that of the row electrode X, Y.

The PDP has the construction in which each of the phosphor layers 7 is formed on the back glass substrate 4 in order to reduce degradation of the phosphor layer 7 due to the ion bombardment in a sustaining discharge for an long life of the PDP, and also the dielectric layer 2 has a flat surface facing each discharge cell C in order to improve luminous efficiency of the phosphor layer 7, and a surface discharge d is produced between the row electrodes X and Y as illustrated in FIG. 17.

However, in the PDP constructed as described above, because the phosphor layers 7 are provided on the back glass substrate 4 in order to increase a life of the PDP and also the sustaining discharge between the row electrodes X and Y is created in a surface discharge mode, the sustaining discharge in the surface discharge mode requires a driving voltage higher than that required when a sustaining discharge between the row electrodes X and Y is created in an opposite discharge mode, leading to a problem of a need of expensive circuit components capable of withstanding high voltage.

SUMMARY OF THE INVENTION

The present invention has been made to solve the above-described problems associated with the surface-discharge matrix plasma display panels.

Accordingly, it is an object of the present invention to provide a surface-discharge-type matrix plasma display panel capable of producing a discharge between row electrodes at low driving voltage.

To attain this object, the present invention provides a plasma display panel including: a pair of substrates opposite to each other with a discharge space interposed therebetween; a plurality of row electrode pairs provided on an inner surface of one substrate of the pair of the substrates, regularly arranged in a column direction and each extending in a row direction to form a display line; a plurality of column electrodes provided on an inner surface of the other substrate of the pair of the substrates, regularly arranged in the row direction and each extending in the column direction to intersect the row electrode pairs and form unit light-emitting areas in the discharge space at the respective intersections; and a discharge gap provided between a pair of the row electrodes constituting each of the row electrode pairs in each unit light-emitting area. The plasma display panel according to a first feature of the present invention comprises: a dielectric layer provided on the inner surface of the one substrate to cover the row electrode pairs, and having a thickness in a portion opposite each of the discharge gaps smaller than a thickness in portions positioned on both sides of the portion opposite the discharge.

In the plasma display panel of the first feature, a discharge pulse is applied between the row electrodes constituting each row electrode pair provided on the one substrate to initiate a surface discharge on a surface of the dielectric layer facing the discharge space. The resulting discharge causes a phosphor layer formed on the other substrate to emit light for generation of an image on the display surface of the panel.

On the face of the dielectric layer facing the discharge space, the dielectric layer is designed such that the portion opposite to each discharge gap between the paired row electrodes has a thickness smaller than that of the other portions on both sides of it so as to make a recess. Due to this design, in a discharge created between the row electrodes of the row electrode pair, the discharge occurring inside the recess is produced in a mode close to an opposite discharge mode.

According to the first feature, in the plasma display panel adopting the surface discharge mode with the aim of extending its life, a discharge occurring in a position opposite to the discharge gap between the row electrodes is closely analogous to an opposite discharge mode, which is thus increased in electric field strength. For this reason, the present invention requires a lower driving voltage for a discharge than that in prior art surface-discharge-type plasma display panels, and eliminates the need for expensive circuit components withstanding high voltage.

Further, with a decrease in a driving voltage for causing a discharge between the row electrodes, a reset-discharge voltage decreases, leading to improvement in dark contrast on a display screen of the panel.

To attain the aforementioned object, the plasma display panel according to a second feature comprises, in addition to the configuration of the first feature, a recess provided in a position opposite each of the discharge gaps on the surface of the dielectric layer facing the discharge space to make a thickness of the portion of the dielectric layer opposite the discharge gap smaller than a thickness of the portions of the dielectric layer positioned on both sides of the portion opposite the discharge gap.

According to the second feature, a recess facing the discharge space is formed in the portion of the dielectric layer opposite the discharge gap between the row electrodes. Hence, when a discharge is created between the row electrodes, the discharge occurring inside the recess is produced in a mode close to an opposite discharge mode. This design allows the surface-discharge-type plasma display panel to increase an electric field strength of a discharge between the row electrodes to thereby provide a decreased driving voltage for the discharge.

To attain the aforementioned object, the plasma display panel according to a third feature has, in addition to the configuration of the second feature, a configuration that the recess is formed in a band-like shape extending parallel to the row direction through the adjacent unit light-emitting areas in the row direction.

According to the third feature, a discharge between the row electrodes occurring in the recess formed in the dielectric layer in a band-like shape extending parallel to the row direction, is produced in a mode close to an opposite discharge mode. Thus, the surface-discharge-type plasma display panel is allowed to increase an electric field strength of a discharge between the row electrodes for a decrease in a driving voltage for the discharge.

Further, the band-shaped recess is formed so as to extend through the adjacent unit light-emitting areas in the row direction. With this design, for example, even when the unit light-emitting areas adjacent to each other in the row direction are blocked from each other by an additional dielectric layer which is formed on the dielectric layer or a partition wall defining the unit light-emitting areas, the recess provides communication between the adjacent unit light-emitting areas. Thus it is possible to make full use of the so-called priming effect of triggering a discharge to occur in a unit light-emitting area and transfer to the adjacent unit light-emitting area.

To attain the aforementioned object, the plasma display panel according to a fourth feature has, in addition to the configuration of the second feature, a configuration that the recess is formed separately in each unit light-emitting area.

According to the fourth feature, a discharge between the row electrodes occurring in the recess formed in the dielectric layer separately in each unit light-emitting area, is produced in a mode close to an opposite discharge mode. Thus, the surface-discharge-type plasma display panel is allowed to increase an electric field strength of a discharge between the row electrodes for a decrease in a driving voltage for the discharge.

To attain the aforementioned object, the plasma display panel according to a fifth feature comprises, in addition to the configuration of the second feature, a pair of protrusions projecting into the discharge space in positions on the surface of the dielectric layer facing the discharge space corresponding to leading ends of the respective row electrodes facing each other with the interposed discharge gap, the recess being formed between the pair of protrusions.

According to the fifth feature, due to a pair of protrusions respectively formed in the positions opposite the leading ends of the row electrodes on the dielectric layer, the dielectric layer has a thickness in its portions opposite the leading ends concerned larger than that in its other portions, so that the recess sandwiched between the pair of protrusions is formed in a portion of the dielectric layer opposite the discharge gap.

A discharge between the row electrodes occurring in the recess sandwiched between the pair of protrusions of the dielectric layer is produced in a mode close to an opposite discharge mode. Thus, the surface-discharge-type plasma display panel achieves an increase in electric field strength of a discharge between the row electrodes to decrease a driving voltage for the discharge.

To attain the aforementioned object, the plasma display panel according to a sixth feature has, in addition to the configuration of the fifth feature, a configuration that the dielectric layer has a thickness in a portion opposite a base end of each of the row electrodes smaller than that in the portion opposite the leading end of the row electrode and with the protrusion formed on.

According to the sixth invention, a discharge between the row electrodes occurring in the recess sandwiched between the pair of protrusions of the dielectric layer is produced in a mode close to an opposite discharge mode. Thus, the surface-discharge-type plasma display panel achieves an increase in field strength of a discharge between the row electrodes to decrease a driving voltage for the discharge.

Further the dielectric layer has a smaller thickness in the portions opposite the base ends of the row electrodes, namely, in the portions on both sides of the pair of protrusions, in each unit light-emitting area. This design allows for an increase in the path length of the discharge between the row electrodes, extending between the portions of the dielectric layer situated on both sides of the pair of protrusions. Such a long discharge path provides improvement in luminous efficiency of the phosphor layer formed on the other substrate with the column electrode formed on.

To attain the aforementioned object, the plasma display panel according to a seventh feature has, in addition to the configuration of the sixth feature, a configuration that the dielectric layer has a thickness in the portion opposite the discharge gap and with the recess formed thereon smaller than a thickness in the portion opposite the base end of the row electrode.

In the seventh feature, the dielectric layer is designed to decrease in thickness of the portion positioned opposite the discharge gap and between the pair of protrusions, that is, the recess formed between the pair of protrusions is increased in depth. Accordingly, a discharge between the row electrodes occurring in the increased-depth recess is produced in much closer to the opposite discharge mode. Thus, the surface-discharge-type plasma display panel achieves an increase in field strength of a discharge between the row electrodes to decrease a driving voltage for the discharge.

To attain the aforementioned object, the plasma display panel according to an eighth feature comprises, in addition to the configuration of the first feature, a recess provided in a portion opposite to a base end of each row electrode on the surface of the dielectric layer facing the discharge space in each unit-light-emitting area to make a thickness of the portion of the dielectric layer opposite the base end of the row electrode smaller than a thickness of a portion of the dielectric layer opposite a leading end of the row electrode.

According to the eighth feature, the recesses are respectively formed in the portions of the dielectric layer opposite the base ends of the row electrodes. The recesses provide a decrease of the thickness of the portions of the dielectric layer on both sides of the portions respectively opposite the leading end of each row electrode. This design allows for an increase in the path length of the discharge between the row electrodes, extending between the portions of the dielectric layer situated on both sides of the portions respectively opposite the leading ends of the row electrodes. Such a long discharge path provides improvement in luminous efficiency of the phosphor layer formed on the other substrate with the column electrode formed.

To attain the aforementioned object, the plasma display panel according to a ninth feature has, in addition to the configuration of the eighth feature, a configuration that the recess provided in the portion of the dielectric layer opposite each of the base ends of the row electrode is shaped in a band-like form extending in parallel to the row direction through the adjacent unit light-emitting areas in the row direction.

According to the ninth feature, due to the design that the band-shaped recess formed in the dielectric layer extends through the adjacent unit light-emitting areas in the row direction, even when the adjacent unit light-emitting areas in the row direction are blocked from each other by the partition wall provided for defining the unit light-emitting areas or an additional element formed on the dielectric layer, for example, the recess provides communication between the adjacent unit light-emitting areas. Thus it is possible to make full use of the so-called priming effect of triggering a discharge to occur in a unit light-emitting area and transfer to the adjacent unit light-emitting area.

To attain the aforementioned object, the plasma display panel according to a tenth feature has, in addition to the configuration of the first feature, a configuration that the portion of the dielectric layer with the smaller thickness opposite the discharge gap has a center point offset from a center point of the discharge gap.

According to the tenth feature, the center point of the recess formed in the thinner portion of the dielectric layer opposite the discharge gap is offset from the center point of the discharge gap, but the discharge between the row electrodes occurs in a mode close to the opposite discharge mode in the recess of the dielectric layer, resulting in a decreased driving voltage for the discharge.

These and other objects and features of the present invention will become more apparent from the following detailed description with reference to the accompanying drawings.

DETAILED DESCRIPTION OF THE PREFERRED EMBODIMENT

Preferred embodiments according to the present invention will be described hereinafter in detail with reference to the accompanying drawings.

Figure 1:
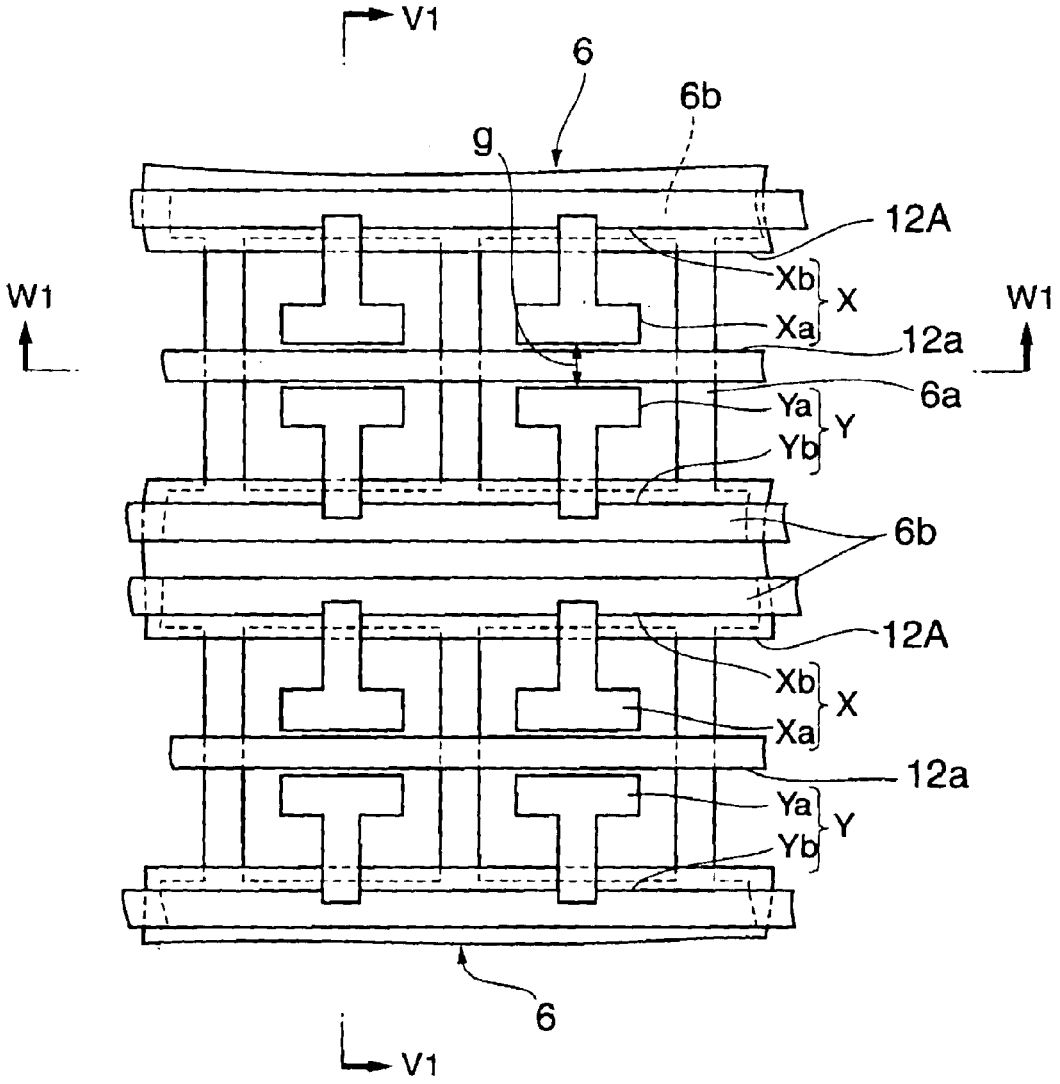
FIG. 1 is a schematic front view illustrating a first embodiment according to the present invention.
Figure 2:
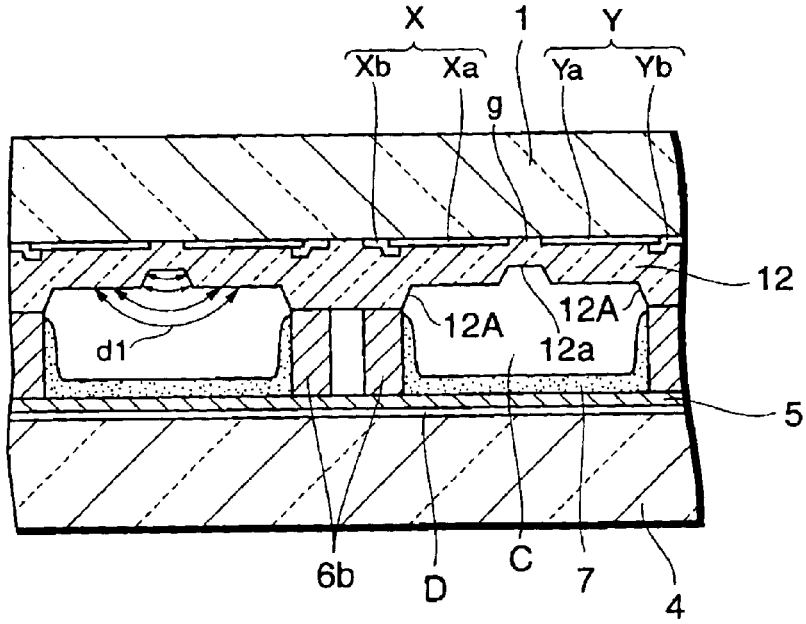
FIG. 2 is a sectional view taken along the V1—V1 line of FIG. 1.
Figure 3:
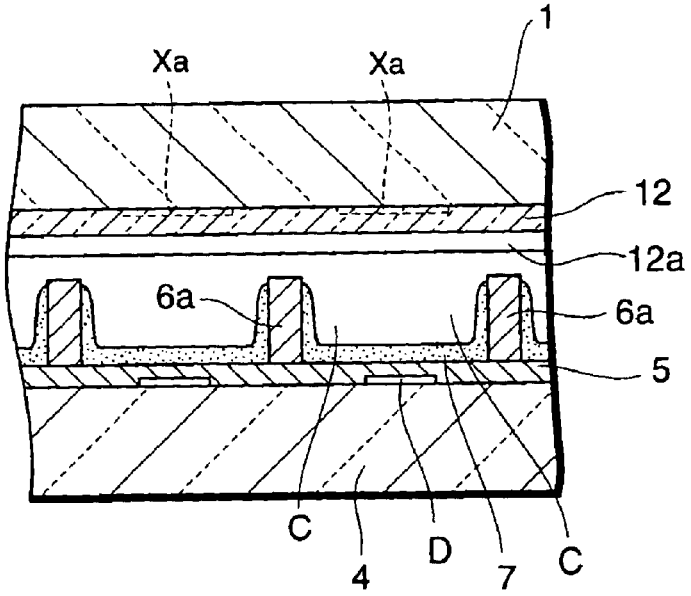
FIG. 3 is a sectional view taken along the W1—W1 line of FIG. 1.

A first embodiment of a plasma display panel (hereinafter referred to as "PDP") according to the present invention is illustrated in FIG. 1 to FIG. 3, FIG. 1 being a schematic front view of the PDP, FIG. 2 being a sectional view taken along the V1—V1 line of FIG. 1, and, FIG. 3 being a sectional view taken along the W1—W1 line of FIG. 1.

Figure 16:
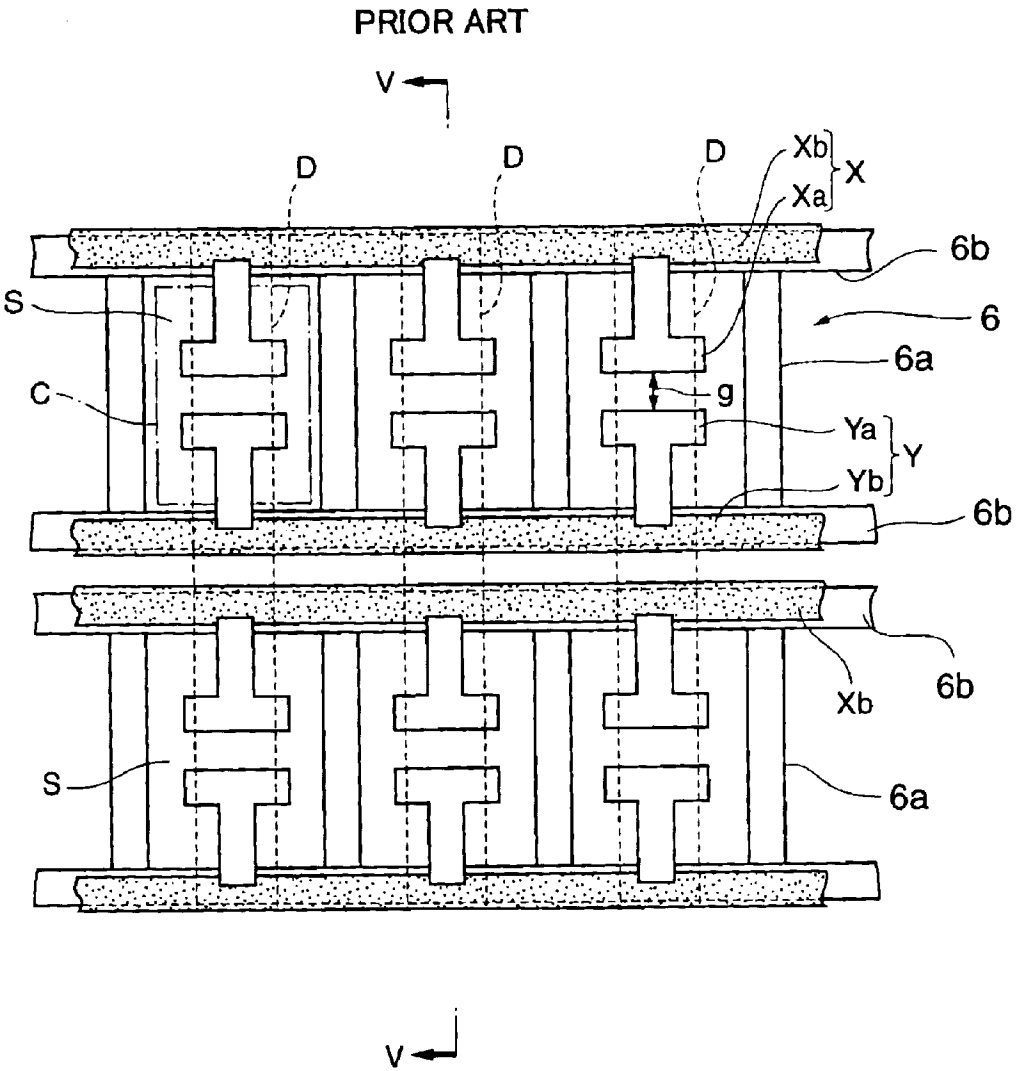
FIG. 16 is a front view illustrating an example of the prior art.
Figure 17:
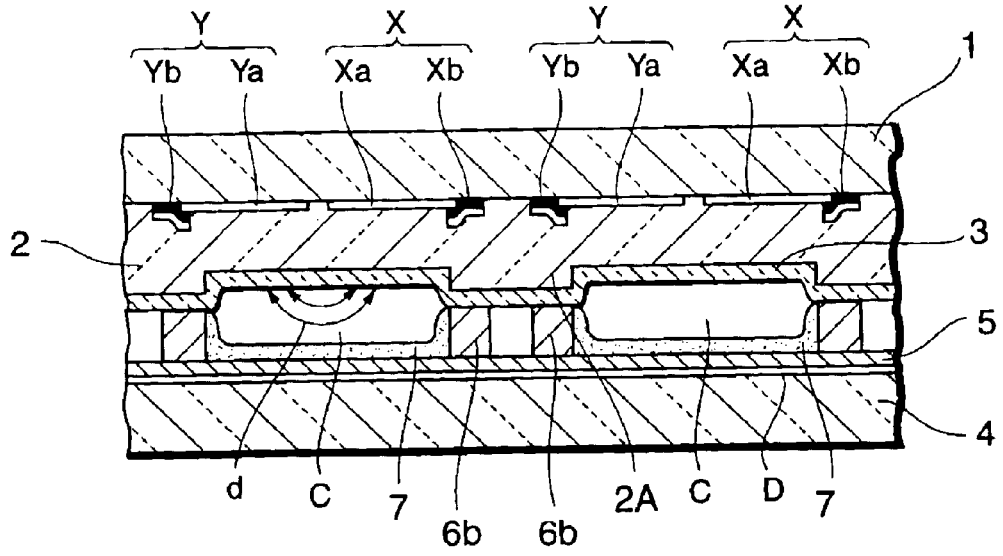
FIG.17 PRIOR ART
FIG. 17 is a sectional view taken along the V—V line of FIG. 16.

A front glass substrate 1, a back glass substrate 4, a column-electrode protective layer 5, a partition wall 6, a phosphor layer 7, a row electrode pair (X, Y) and a column electrode D of the PDP illustrated in FIGS. 1 to 3 have the same configuration as those of the PDP illustrated in FIGS. 16 and 17, and are designated by the same reference numerals as those in FIGS. 16 and 17. Note that a protective layer 3 is omitted in FIGS. 1 to 3.

In the first embodiment, a dielectric layer 12 is provided on the back surface of the front glass substrate 1 and covers the row electrode pairs (X, Y). The dielectric layer 12 has a back surface on which a band-shaped recess groove 12*a* extending in the row direction (the right-left direction in FIG. 1) is formed in a position opposite each discharge gap g between transparent electrodes Xa and Ya of the row electrode pair (X, Y). Because of this recess groove 12*a*, the dielectric layer 12 has a thickness in a portion opposite a discharge gap g of the row electrode pair (X, Y) smaller than that in other portions thereof.

In the PDP of the first embodiment, when a sustaining discharge is created between the transparent electrodes Xa and Ya of the row electrode pair (X, Y), the sustaining discharge between the transparent electrodes Xa and Ya occurs, in a region in which the recess groove 12*a* is formed, in a mode close to an opposite discharge rather than a surface discharge typically occurring in prior art PDPs, resulting in an increase of the electric field strength of the discharge.

Thus, a lower driving voltage is advantageously required for producing the sustaining discharge as compared with that of prior art PDPs adopting the surface discharge mode, resulting in elimination of a need of expensive circuit components withstanding high voltage.

In association with the reduced driving voltage for producing a sustaining discharge, a reduced voltage is also required for producing a reset discharge between the transparent electrodes Xa and Ya of the row electrode pair (X, Y), leading to improvement in dark contrast on the display screen of the PDP.

The closer to an angle of 90 degrees to the front glass substrate leach side face of the recess groove 12*a* is, the closer to an opposite discharge mode the discharge between the transparent electrodes Xa and Ya becomes, and in turn the smaller the driving voltage for the discharge becomes.

As in cases of prior art PDPs, the PDP according to the present invention includes an additional dielectric layer 12A provided in the portion of the dielectric layer 12 opposite adjacent bus electrodes Xb and Yb of the respective row electrode pairs (X, Y) positioned back to back plus opposite a region between the adjacent bus electrodes Xb and Yb concerned. The additional dielectric layer 12A extends in parallel to the bus electrodes Xb, Yb, and protrudes from the back surface of the dielectric layer 12 to come in contact with transverse walls 6*b* of a partition wall 6 to close the adjacent discharge cells C in the column direction from each other.

On the other hand, the adjacent discharge cells C in the row direction are communicated with each other through a clearance formed between the protective layer covering the dielectric layer 12 and a vertical wall 6*a* of the partition wall 6 plus a clearance formed by the recess groove 12*a*. This communication section is used for exhausting air from the discharge space and then feeding a discharge gas into the discharge space in the manufacturing process for the PDP. Additionally, the communication section has a function of allowing charged particles generated by a discharge to flow therethrough to provide the priming effect of causing successive discharges as in a chain reaction.

At this point, the discharge cells C adjacent to each other in the row direction are communicated with each other, but there is no likelihood that the discharge between the transparent electrodes Xa and Ya spreads out into an adjacent discharge cell C in the row direction because each of the transparent electrodes Xa and Ya of the row electrode pair (X, Y) is formed separately in an island-like form in each discharge cell C.

Figure 4:
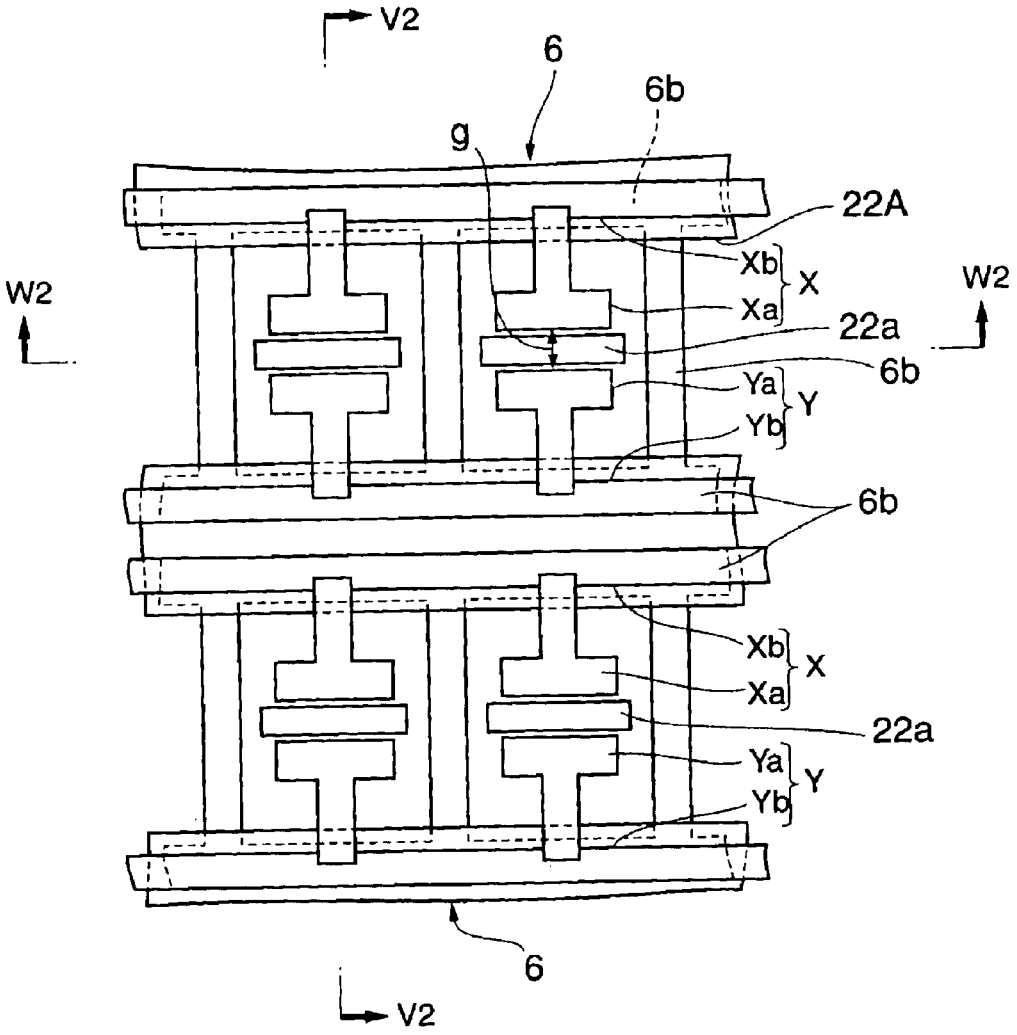
FIG. 4 is a schematic front view illustrating a second embodiment according to the present invention.
Figure 5:
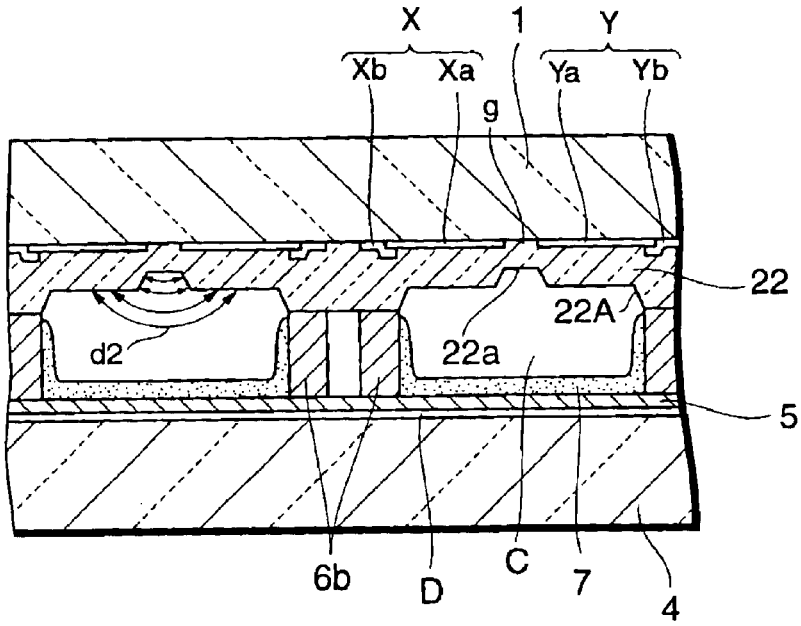
FIG. 5 is a sectional view taken along the V2—V2 line of FIG. 4.
Figure 6:
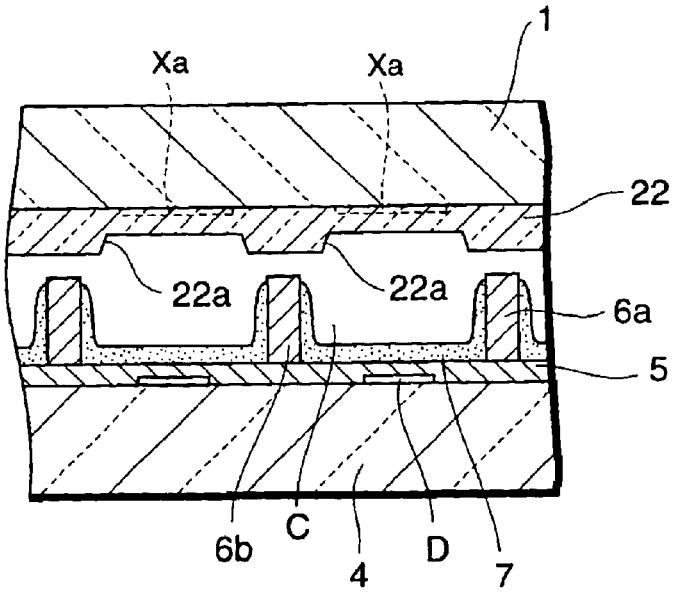
FIG. 6 is a sectional view taken along the W2—W2 line of FIG. 4.

FIGS. 4 to 6 illustrate a second embodiment of the PDP according to the present invention, FIG. 4 being a schematic front view of the PDP, FIG. 5 being a sectional view taken along the V2—V2 line of FIG. 4, and, FIG. 6 being a sectional view taken along the W2—W2 line of FIG. 4.

In FIGS. 4 to 6, a dielectric layer 22 covers the row electrode pairs (X, Y) and has a back surface on which a recess groove 22*a* is formed in a central position opposite the discharge gap g between the transparent electrodes Xa and Ya of the row electrode pair (X, Y) in each discharge cell C. The recess groove 22*a* has a rectangular planar shape of which the longitudinal direction extends in parallel to the row direction (the right-left direction in FIG. 4). Due to the groove 22*a*, the dielectric layer 22 has a thickness in the portion opposite the discharge gap g of the row electrode pair (X, Y) smaller than that in the other portions thereof.

The configuration of other components in the second embodiment is similar to that of the PDP in the first embodiment, and the same reference numerals as in the first embodiment are designated.

As in the PDP in the first embodiment, in the PDP in the second embodiment, when a discharge is created between the transparent electrodes Xa and Ya of the row electrode pair (X, Y), the discharge d2 between the transparent electrodes Xa and Ya occurs, in the region in which the recess groove 22*a* is formed, in a mode close to an opposite discharge rather than a surface discharge typically occurring in prior art PDPs, to increase in electric field strength. Thus, a lower driving voltage is advantageously required for producing the sustaining discharge as compared with prior art PDPs adopting the surface discharge mode, resulting in elimination of a need of expensive circuit components withstanding high voltage.

Figure 7:
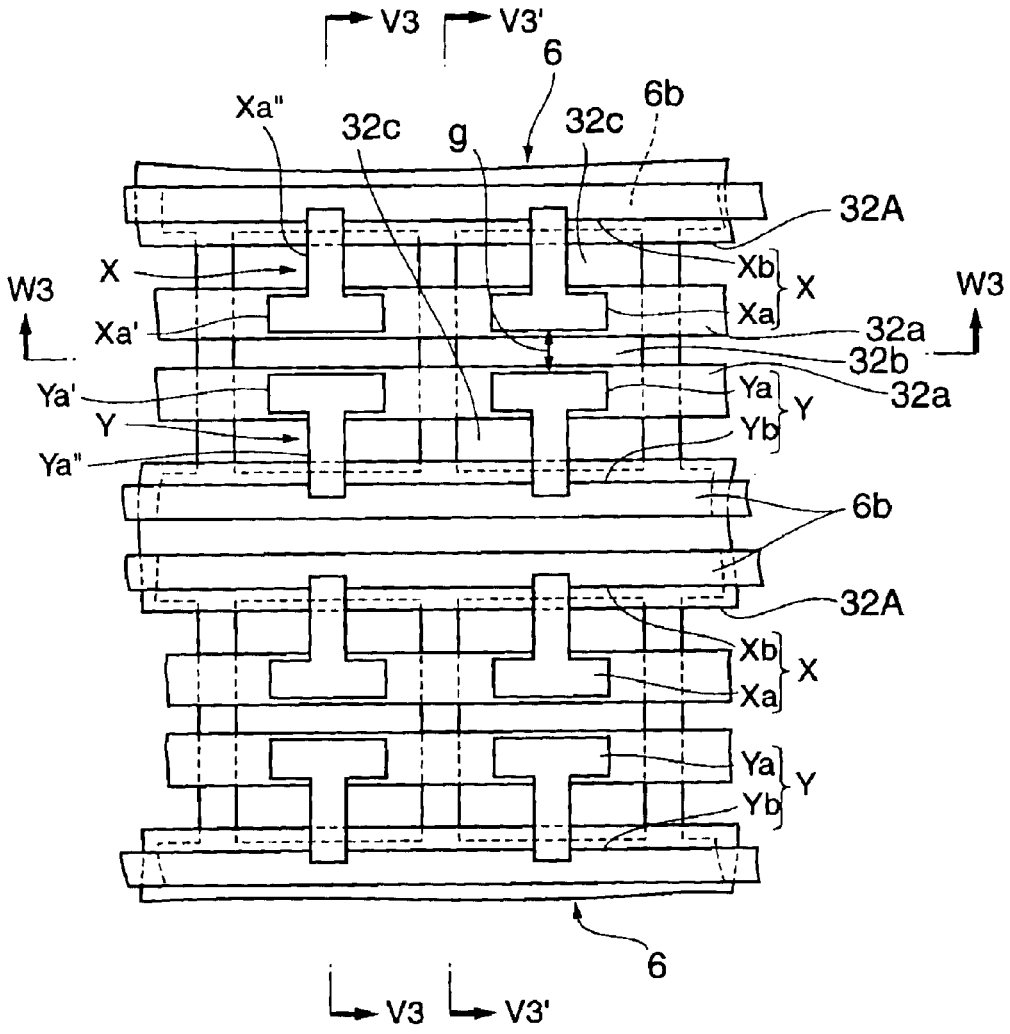
FIG. 7 is a schematic front view illustrating a third embodiment according to the present invention.
Figure 8:
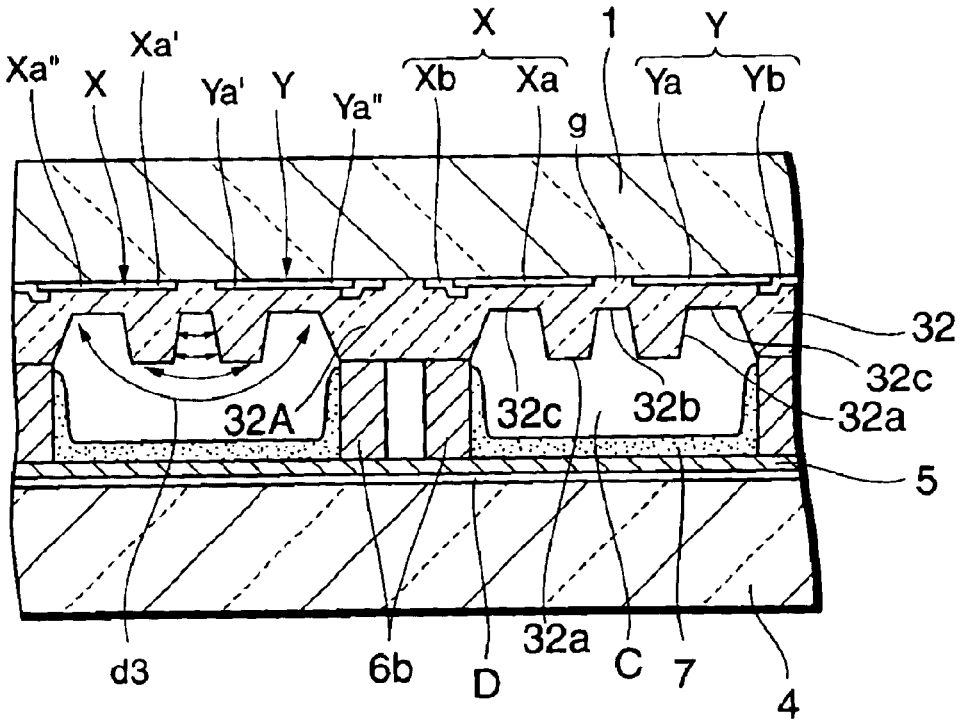
FIG. 8 is a sectional view taken along the V3—V3 line of FIG. 7.
Figure 9:
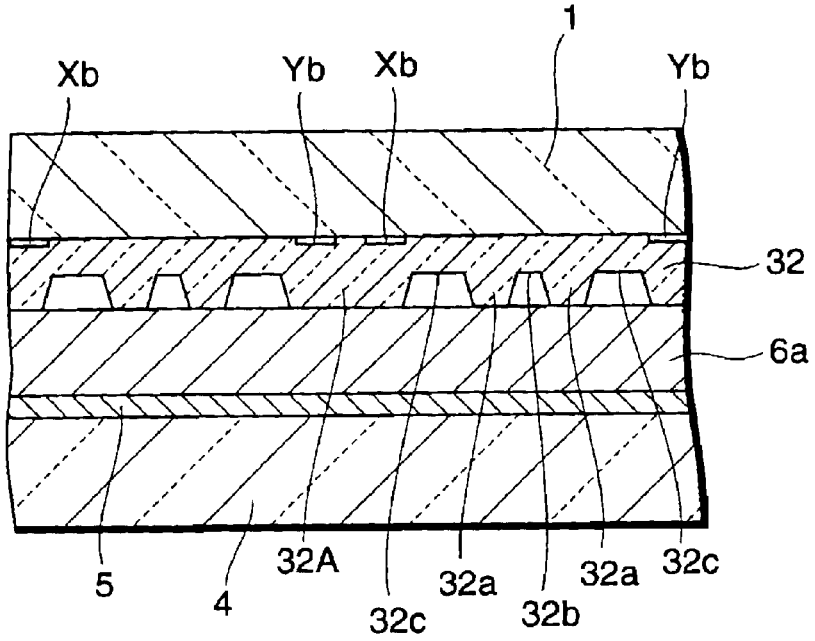
FIG. 9 is a sectional view taken along the V3'—V3' line of FIG. 7.
Figure 10:
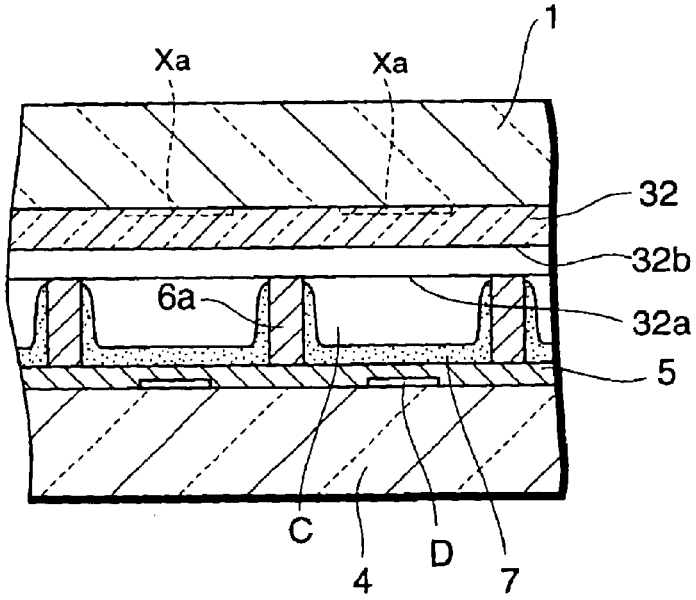
FIG. 10 is a sectional view taken along the W3—W3 line of FIG. 7.

FIGS. 7 to 10 illustrate a third embodiment of the PDP according to the present invention, FIG. 7 being a schematic front view of the PDP, FIG. 8 being a sectional view taken along the V3—V3 line in FIG. 7, FIG. 9 being a sectional view taken along the V3'—V3' line of FIG. 7, and FIG. 10 being a sectional view taken along the W3—W3 line of FIG. 7.

In FIGS. 7 to 10, a dielectric layer 32 covers the row electrode pairs (X, Y) and has a back surface on which a pair of band-shaped protrusion stripes 32*a* are formed respectively in positions opposite to widened leading ends Xa', Ya' of the respective T-shaped transparent electrodes Xa and Ya. The pair of protrusion stripes 32*a* extend in the row direction (the right-left direction in FIG. 7) and project from the back surface of the dielectric layer 32 in the direction of the back glass substrate 4.

By forming the pair of the band-shaped protrusion stripes 32*a*, a recess groove 32*b* is formed in a position opposite the discharge gap g and extends between a pair of the stripes 32*a* in the row direction. Further, recess grooves 32*c* are respectively formed in positions opposite the narrowed base ends Xa" and Ya" of the respective transparent electrodes Xa and Ya and each extends between one of the paired protrusion stripes 32*a* and an additional dielectric layer 32A in the row direction.

The configuration of other components in the third embodiment is similar to that of the PDP in the first embodiment, and the same reference numerals as in the first embodiment are designated.

As in the PDP in the first embodiment, in the PDP in the third embodiment, a discharge d3 between the transparent electrodes Xa and Ya of the row electrode pair (X, Y) occurs inside the recess groove 32*b* formed between a pair of the protrusion strips 32*a*, in a mode close to an opposite discharge, resulting in an increase of the electric field strength of the discharge. Thus, a lower driving voltage is advantageously required for producing the sustaining discharge as compared with prior art PDPs adopting the surface discharge mode, resulting in elimination of a need of expensive circuit components withstanding high voltage.

Additionally, the pair of the band-shaped protrusion strips 32*a* provided in the position opposite the widened leading ends Xa' and Ya' of the transparent electrodes Xa and Ya, effects an increase in the path length of the discharge d3 to improve luminous efficiency of the phosphor layer 7.

The PDP in the third embodiment is designed such that as illustrated in FIG. 9 the discharge cells C adjacent to each other with the interposed vertical walls 6*a* of the partition walls 6 in the row direction are communicated with each other by the recess grooves 32*b* and 32*c*, thereby ensuring the priming effect between the adjacent discharge cells C in the row direction.

Figure 11:
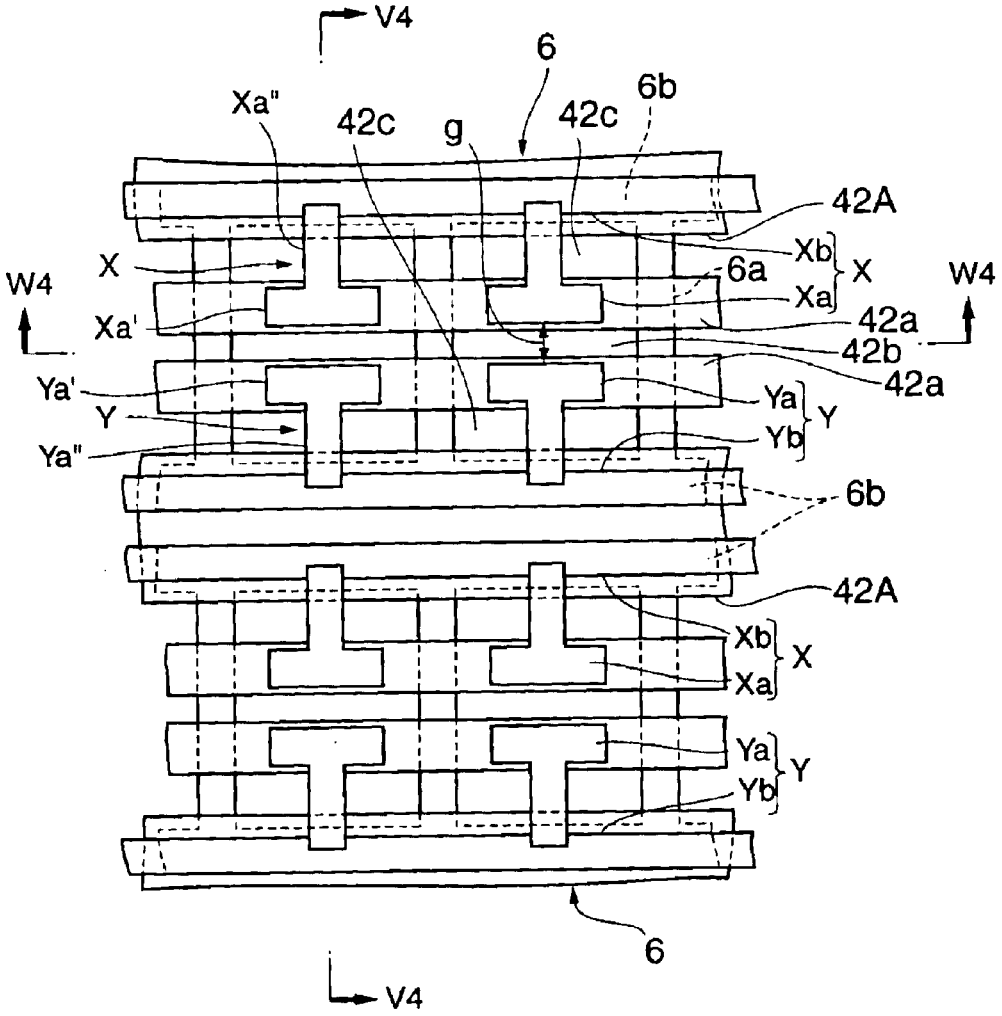
FIG. 11 is a schematic front view illustrating a fourth embodiment according to the present invention.
Figure 12:
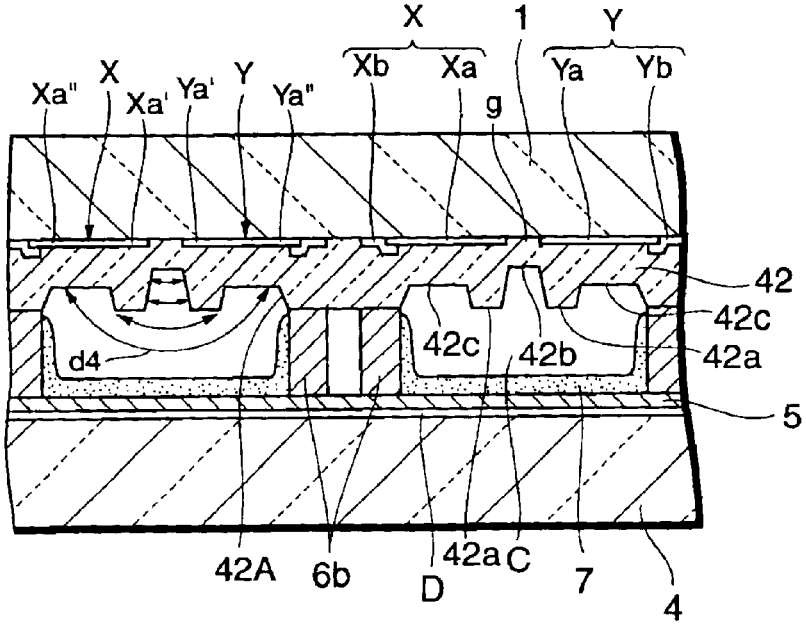
FIG. 12 is a sectional view taken along the V4—V4 line of FIG. 11.
Figure 13:
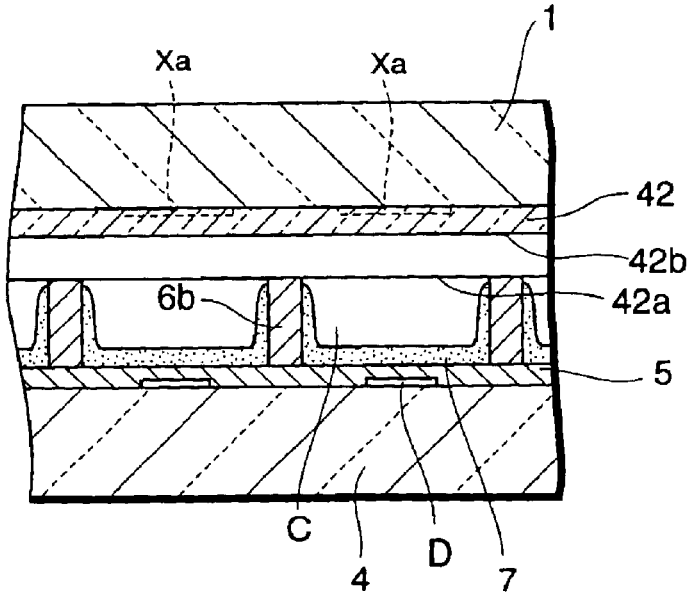
FIG. 13 is a sectional view taken along the W4—W4 line of FIG. 11.

FIGS. 11 to 13 illustrate a fourth embodiment of the PDP according to the present invention, FIG. 11 being a schematic front view of the PDP, FIG. 12 being a sectional view taken along the V4—V4 line of FIG. 11, and FIG. 13 being a sectional view taken along the W4—W4 line of FIG. 11.

As in the PDP described in the third embodiment, the PDP in the fourth embodiment includes a dielectric layer 42 covering the row electrode pairs (X, Y) and having a back surface on which a pair of band-shaped protrusion stripes 42*a* are formed respectively in positions opposite the widened leading ends Xa', Ya' of the respective T-shaped transparent electrodes Xa and Ya. The pair of protrusion stripes 42*a* extend in the row direction and projects from the back surface of the dielectric layer 42 in the direction of the back glass substrate 4.

On the back surface of the dielectric layer 42, by forming the pair of the band-shaped protrusion stripes 42*a*, recess grooves 42*b* are formed in a position opposite the discharge gap g and extends between a pair of the stripes 42*a* in the row direction, and, recess grooves 42*c* are also formed respectively in positions opposite the narrowed base ends Xa", Ya" of the transparent electrodes Xa, Ya and each extend in the row direction between one of the paired protrusion stripes 42*a* and an additional dielectric layer 42A.

The dielectric layer 42 is designed to have a thickness in a portion between the pair of protrusion stripes 42*a* smaller than that in a portion with each recess groove 42*c* formed in. Further, a recess groove 42*b* is formed between the pair of protrusion stripes 42*a* and has a depth greater than that of the recess groove 42*c*.

The configuration of other components in the fourth embodiment is similar to that of the PDP in the first embodiment, and the same reference numerals as in the first embodiment are designated.

As in the PDP in the third embodiment, in the PDP in the fourth embodiment, a discharge d4 between the transparent electrodes Xa and Ya of the row electrode pair (X, Y) occurs inside the recess groove 42*b* formed between a pair of the protrusion strips 42*a*, in a mode close to an opposite discharge, resulting in an increase of the electric field strength of the discharge. Thus, a lower driving voltage is advantageously required for producing the discharge, resulting in elimination of a need of expensive circuit components withstanding high voltage.

Additionally, the recess groove 42*b* in which the opposite discharge occurs has a depth greater than that of the recess groove 32*b* in the PDP of the third embodiment. Accordingly, the discharge d4 between the transparent electrodes Xa and Ya is further increased in an electric field strength, resulting in a greater reduction in the required driving voltage for the discharge.

Figure 14:
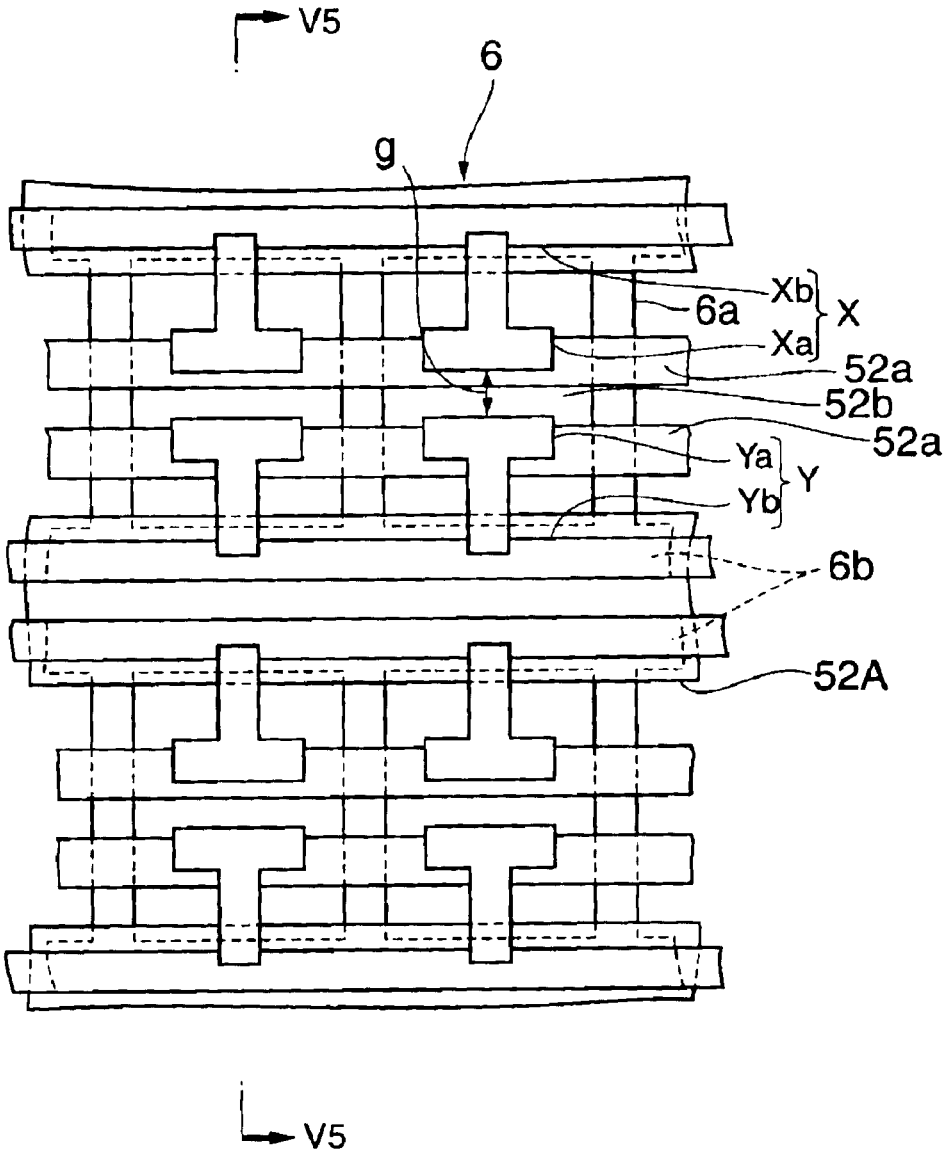
FIG. 14 is a schematic front view illustrating a fifth embodiment according to the present invention.
Figure 15:
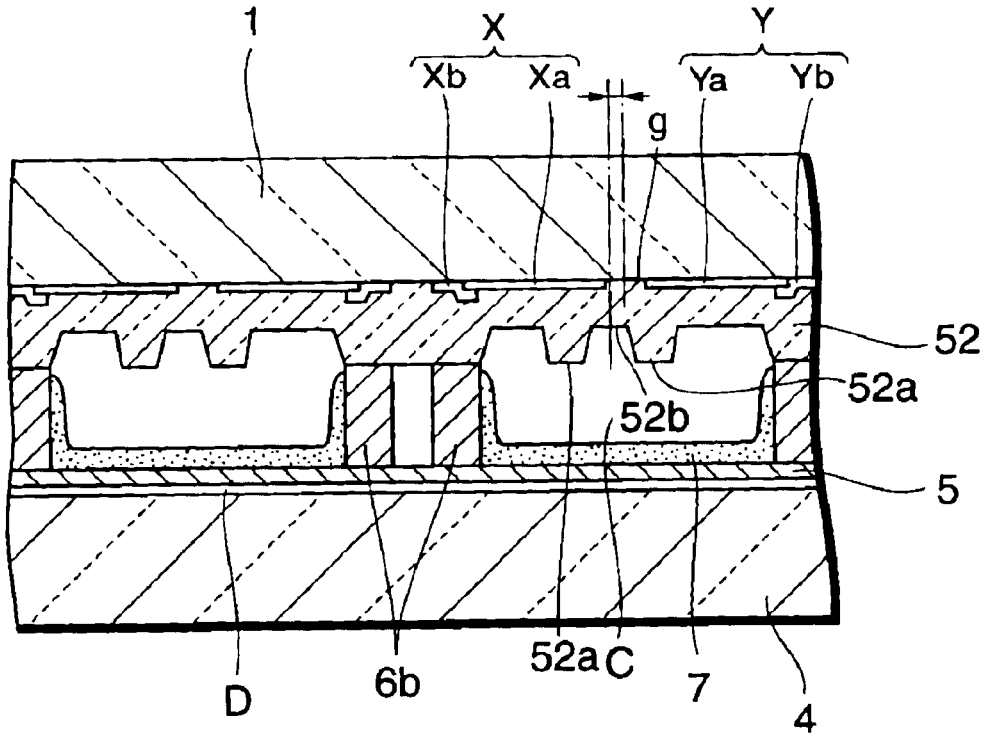
FIG. 15 is a sectional view taken along the V5—V5 line of FIG. 14.

Each of the first to fourth embodiments mentioned thus far describes an exemplary design of a recess groove for causing a discharge approximate to an opposite discharge between the transparent electrodes Xa, Ya which is placed in a position opposite a central position of a discharge gap g between the transparent electrodes Xa, Ya. However, the recess groove may not be necessarily formed in the position opposite the central position of the discharge gap g. For example, as illustrated in a fifth embodiment in FIG. 14 and FIG. 15, the PDP may be designed such that a recess groove 52*b* is provided between a pair of protrusion stripes 52*a* on a dielectric layer 52 in a position in which the center line of the groove 52*b* offsets from a center line of the discharge gap g.

The first to fifth embodiments can adopt various methods for forming a recess groove and a protrusion stripe on the dielectric layer, e.g., printing techniques of patterning thick film materials, photolithographic techniques of patterning a fully-coated layer of a photosensitive glass paste, and the like.

Further, each of the first to fifth embodiments according to the present invention describes an exemplary design of an additional dielectric layer which is formed in a band-like shape extending in the row direction in a position opposite the bus electrodes Xb, Yb plus opposite the region between the bus electrodes Xb and Yb. However, the additional layer may also be provided in a portion opposite the vertical wall 6*a* of the partition wall 6, so that the additional dielectric layers formed on the back surface of the dielectric layer may be formed in a chessboard-square like pattern.

Further, the partition wall 6 described in each of the first to fifth embodiments is shaped in a ladder pattern, but a partition wall may be shaped in a band pattern extending in the column direction to define the discharge cells.

Still further, in each of the first to fifth embodiments described above, in order to prevent the reflection of ambient light incident upon a non-display area of the panel, an additional dielectric layer can be designed as a black- or dark-color light absorption layer, or alternatively, a black- or dark-color light absorption layer can be formed on the bus electrode as well as between the bus electrodes positioned back to back.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including, a pair of substrates opposite to each other with a discharge space interposed therebetween, a plurality of row electrode pairs provided on an inner surface of one substrate of the pair of the substrates, regularly arranged in a column direction and each extending in a row direction to form a display line, a plurality of column electrodes provided on an inner surface of the other substrate of the pair of the substrates, regularly arranged in the row direction and each extending in the column direction to intersect the row electrode pairs and form unit light-emitting areas in the discharge space at the respective intersections, and a discharge gap provided between a pair of the row electrodes constituting each of the row electrode pairs in each unit light-emitting area, said plasma display panel comprising:

a dielectric layer provided on the inner surface of the one substrate to cover the row electrode pairs, and having a thickness in a portion opposite each of the discharge gaps smaller than a thickness in portions positioned on both sides of the portion opposite the discharge gap;

a recess provided in a position opposite each of said discharge gaps on the surface of said dielectric layer facing the discharge space to make a thickness of said portion of the dielectric layer opposite the discharge gap smaller than a thickness of said portions of the dielectric layer positioned on both sides of the portion opposite the a pair of protrusions projecting into the discharge space in positions on the surface of said dielectric layer facing the discharge space corresponding to leading ends of the respective row electrodes facing each other with the interposed discharge gap, said recess being formed between the pair of protrusions.

2. A plasma display panel according to claim 1, wherein said recess is formed separately in each unit light-emitting area.

3. A plasma display panel according to claim 1, wherein said recess is formed in a band-like shape extending parallel to the row direction through the adjacent unit light-emitting areas in the row direction.

4. A plasma display panel according to claim 1, wherein said dielectric layer has a thickness in a portion opposite a base end of each of the row electrodes smaller than that in a portion opposite the leading end of the row electrode and with said protrusion formed on.

5. A plasma display panel according to claim 4, wherein said dielectric layer has a thickness in said portion opposite the discharge gap and with the recess formed thereon smaller than a thickness in said portion opposite the base end of the row electrode.

6. A plasma display panel including, a pair of substrates opposite to each other with a discharge space interposed therebetween, a plurality of row electrode pairs provided on an inner surface of one substrate of the pair of the substrates, regularly arranged in a column direction and each extending in a row direction to form a display line, a plurality of column electrodes provided on an inner surface of the other substrate of the pair of the substrates, regularly arranged in the row direction and each extending in the column direction to intersect the row electrode pairs and form unit light-emitting areas in the discharge space at the respective intersections, and a discharge gap provided between a pair of the row electrodes constituting each of the row electrode pairs in each unit light-emitting area, said plasma display panel comprising:

a dielectric layer provided on the inner surface of the one substrate to cover the row electrode pairs, and having a thickness in a portion opposite each of the discharge gaps smaller than a thickness in portions positioned on both sides of the portion opposite the discharge gap; and a recess provided in a portion opposite to a base end of each row electrode on the surface of said dielectric layer facing the discharge space in each unit-light-emitting area to make a thickness of the portion of the dielectric layer opposite the base end of the row electrode smaller than a thickness of a portion of the dielectric layer opposite a leading end of the row electrode.

7. A plasma display panel according to claim 6, wherein said recess provided in said portion of the dielectric layer opposite each of the base ends of the row electrode is shaped in a band-like form extending in parallel to the row direction through the adjacent unit light-emitting areas in the row direction.

8. A plasma display panel including, a pair of substrates opposite to each other with a discharge space interposed therebetween, a plurality of row electrode pairs provided on an inner surface of one substrate of the pair of the substrates, regularly arranged in a column direction and each extending in a row direction to form a display line, a plurality of column electrodes provided on an inner surface of the other substrate of the pair of the substrates, regularly arranged in the row direction and each extending in the column direction to intersect the row electrode pairs and form unit light-emitting areas in the discharge space at the respective intersections, and a discharge gap provided between a pair of the row electrodes constituting each of the row electrode pairs in each unit light-emitting area, said plasma display panel comprising:

a dielectric layer provided on the inner surface of the one substrate to cover the row electrode pairs, and having a thickness in a portion opposite each of the discharge gaps smaller than a thickness in portions positioned on both sides of the portion opposite the discharge gap;

wherein said portion of the dielectric layer with the smaller thickness opposite the discharge gap has a center point offset from a center point of the discharge gap.

* * * * *